United States Patent [19]

Tout

[11] 4,097,173

[45] Jun. 27, 1978

[54] SELF PLACING AUTOMATIC FORM

[76] Inventor: John R. Tout, 3530 Platt Ave., Fresno, Calif. 93702

[21] Appl. No.: 836,046

[22] Filed: Sep. 23, 1977

[51] Int. Cl.[2] ..... E01C 11/28

[52] U.S. Cl. ..... 404/98; 404/105; 404/108

[58] Field of Search ..... 404/98, 96, 101, 103, 404/72, 83, 102, 105, 118, 119, 108

[56] References Cited

U.S. PATENT DOCUMENTS

| | | | |
|---|---|---|---|
| 1,550,028 | 8/1925 | Hug | 404/103 |
| 2,204,021 | 6/1940 | Leatherman | 404/98 |
| 2,587,321 | 2/1952 | Hohnke | 404/98 |
| 2,831,408 | 4/1958 | Konway | 404/98 |
| 2,881,683 | 4/1959 | Konway | 404/98 |
| 2,962,948 | 12/1960 | Tout | 404/98 |
| 3,223,006 | 12/1965 | Jones | 404/98 |
| 3,362,308 | 1/1968 | Austin | 404/98 X |
| 3,382,784 | 5/1968 | Loveland | 404/118 X |
| 3,389,646 | 6/1968 | Ruggles | 404/98 X |
| 3,915,583 | 10/1975 | Aparicio | 404/98 |

*Primary Examiner*—Nile C. Byers

[57] ABSTRACT

This machine consists primarily of a frame, which is supported by wheels, and the frame supports three spaced-apart self-placing form units, which operate in conjunction with finishing rollers. The self-placing form units of the machine are faced with endless synthetic rubber belts, which are backed up by hinged steel pads, and the top and bottom of the self-placing form units are sealed with a plate having a lip at the edge, to overlap the synthetic rubber, so as to repel any foreign matter, or concrete mix, from entering the inside of the units. The machine is reversible in direction when desired, and is used for concrete curb and gutter construction.

4 Claims, 4 Drawing Figures

SELF PLACING AUTOMATIC FORM

This invention relates to concrete curb and gutter machines, and more particularly, to a self-placing automatic form machine.

This invention is a continuation-in-part of my prior patent, SELF-PROPELLED CURB FINISHING MACHINE, U.S. Pat. No. 2,962,948, which was filed Feb. 18, 1958.

It is, therefore, the principal object of this invention to provide a self-placing automatic form machine, which will be used for concrete curb and gutter construction.

Another object of this invention is to provide a self-placing automatic form machine, which will be adaptable for highway concrete pavement construction, and the present invention is designed to be used in conjunction with my aforementioned patent.

A further object of this invention is to provide a self-placing automatic form machine, which will be reversible in travel, so as to enable the operator to make another pass.

Other objects of the invention are to provide a self-placing automatic form machine, which is simple in design, inexpensive to manufacture, rugged in construction, easy to use and efficient in operation.

These, and other objects, will be readily evident, upon a study of the following specification and the accompanying drawings, wherein.

Figure 1:
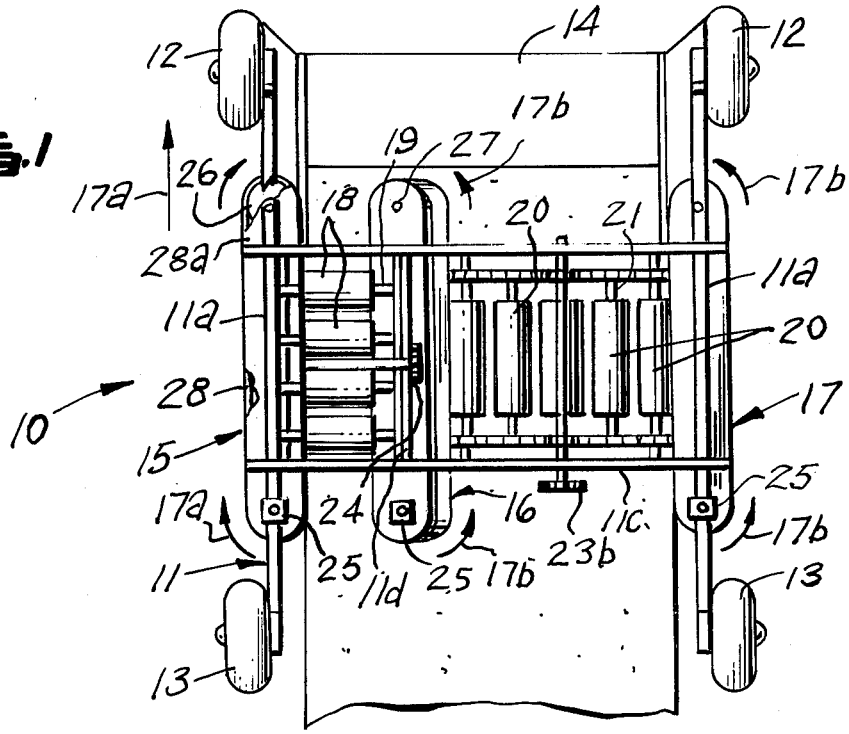
FIG. 1 is a top plan view of the present invention.
Figure 2:
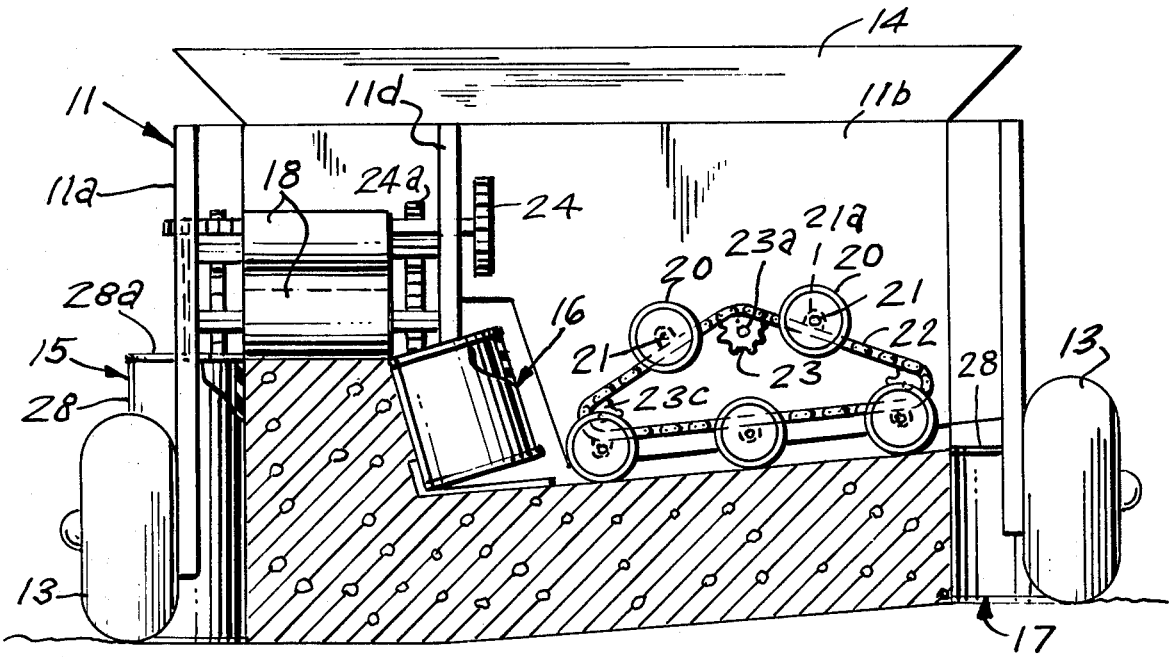
FIG. 2 is an enlarged, fragmentary, rear end view of FIG. 1.

According to this invention, a self-placing automatic form machine 10 is shown to include a frame 11, having side walls 11*a*, a front wall 11*b*, a rear wall 11*c*, and an inner wall 11*d*. Frame 11 is provided with rotatable front wheels 12, and rear wheels 13, which support frame 11. The front wheels 12 and rear wheels 13 are traction wheels for rolling on prepared sub grade. The two front wheels 12 are adaptable for use with commonly manufactured sensor controlled steering. A hopper 14 is secured to the front of machine 10, for receiving low slump concrete mix. A self-placing form unit 15 is secured to the left of frame 11, and spaced apart, and parallel therewith, is an angularly positioned self-placing form 16, and on the right side of frame 11 is secured a self-placing form 17, similar to 15. When machine 10 is travelling forward as indicated by the arrow 17*a*, the self-placing form units 15, 16 and 17 move in the direction indicated by the arrows 17*b*.

A plurality of spaced-apart finishing rollers 18 are supported upon shafts 19, which are supported within walls 11*a* and 11*d*. A plurality of finishing rollers 20, at right angles to rollers 18, are supported upon shafts 21, which are secured within lugs 21*a* of endless chains 22, which are driven by sprockets 23 upon shaft 23*a*. Shaft 23*a* has, secured to it, a drive sprocket 23*b*, and idler sprockets 23*c* provide support means for the endless chains 22, in a triangular configuration. Drive sprocket 24, through gear 24*a* means, serves to rotate the finishing rollers 18. Hydraulic motors 25 serve as a means of driving self-placing form units 15, 16 and 17, and rollers 26, on shafts 27, are in engagement with the endless belts 28, of synthetic rubber. Each of the self-placing form units 15, 16 and 17 are provided with a plate 28*a*, on both the top and the bottom, so as to repel foreign matter, or concrete mix, from entering units 15, 16, and 17. The plates 28*a* are overhung of the surfaces of the endless synthetic rubber belts 28, for repelling concrete mix and foreign matter.

The self-placing form units 15, 16 and 17, with rollers 18 and 20, will operate on the final cement finishing, keeping always on grade. The roller 18 and 20 are powered to run in either direction, while always maintaining the grade to the high side.

It shall be noted, that the units 15, 16 and 17 may be driven on the rear sprockets, together with the four wheels 12 and 13. The traction in six places will provide adequate purchase traction to move machine 10 forward, as this machine 10 is of such structure, so as to keep the weight at a minimum. The movement of the forward motion can be controlled by a common electronic sensor system, so as to move ahead only when the roller 18 and 20 are working on grade. The units 15, 16 and 17, in conjunction with the rollers 18 and 20, can be sensor controlled separately from the main frame 11, so as to keep on line and grade. It is desirable to drive units 15, 16 and 17 on both front and rear, always using the power in the rear.

Machine 10 is movable by power in either direction, in order to back up or make another pass. The rollers 18 and 20 are not individually powered, they roll freely upon their respective shafts 19 and 21. Machine 10 will have a water tank spray line and burlap drag in the rear, when needed.

The units 15, 16, 17 have the endless belts 28, backed up by hinged steel pads, which turn on 6 inch diameter sprocket rollers 26, front rear at 24 inch centers inside of the units 15, 16, and 17. The endless belts 28 are contiguous with the concrete mix. After placing the low slump concrete mix in the hopper 14, and between the units 15, 16 and 17, the machine 10 is moved forward at 15 feet per minute, while the finishing rollers 18 and 20 remove excess concrete from the top of the curb and surface of the gutter. The low slump concrete is compacted tightly against the endless belts 28. As the machine 10 is being moved forward by the traction of the wheels 12 and 13, the rubber endless belts 28 are rotated by the friction against the concrete at the same speed. By attaching power to the rear sprockets of units 15, 16, and 17, they may be driven in unison with the wheels 12 and 13, which will help to propel machine 10 up steep grades. The method of forming used with the plurality of rollers 18 and 20 for finishing is excellent, as concrete is removed when excess is met by each of the rollers 18 and 20, which produces a grade of a fine tolerance, and expansion joints are installed ahead of machine 10, as working over expansion joints, they are hardly disturbed. They are set in the concrete, one-quarter of an inch below finish, ahead of the rollers 18 and 20, and the forms 15, 16, and 17. Expansion joints are cleaned up and edged, leaving a smooth clean surface after machine 10 passes over them.

It shall further be recognized, that the units 15, 16, and 17 are designed to operate separately with the rollers 18 and 20, from the main frame 11 of machine 10.

Figure 3:
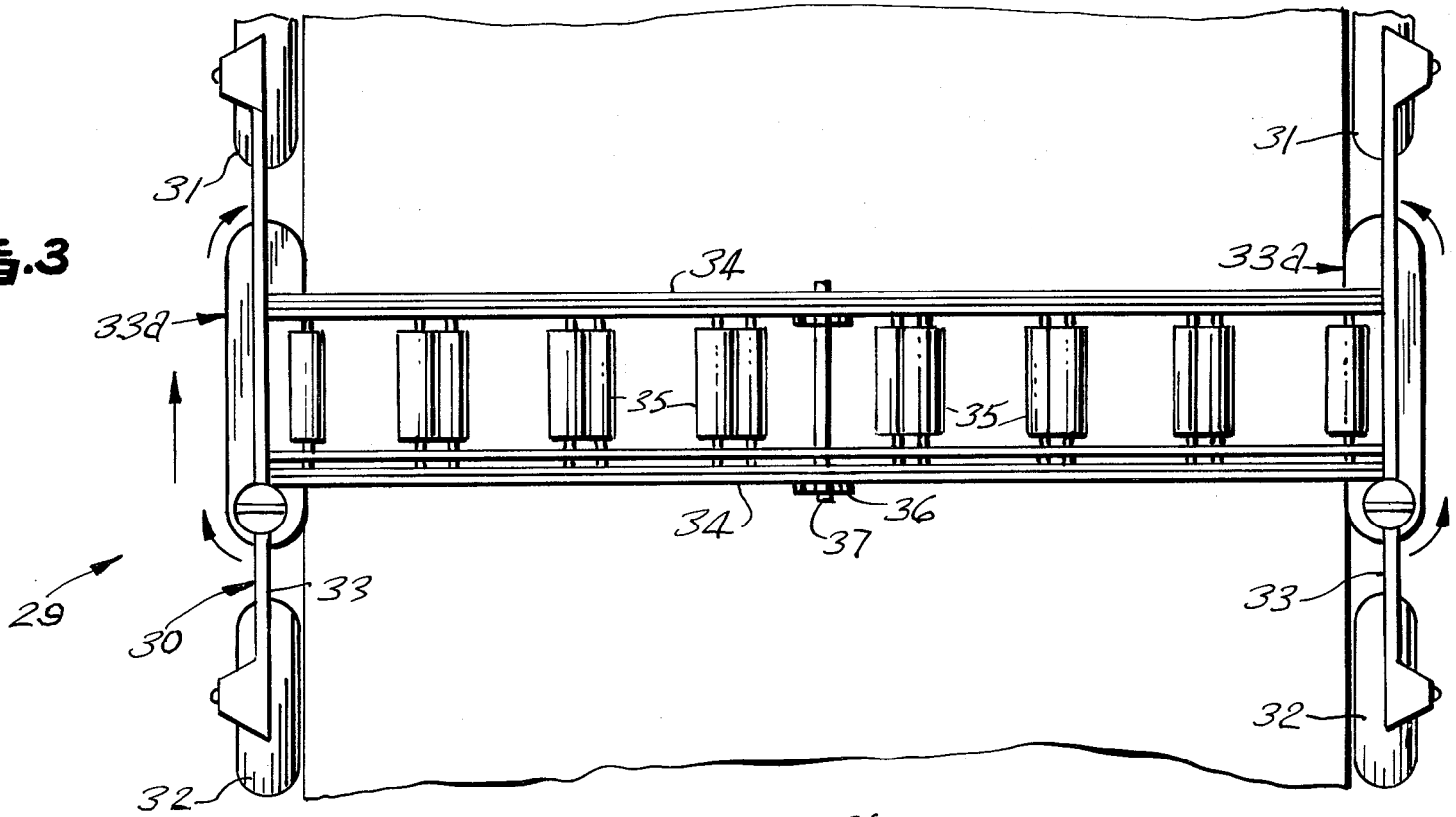
FIG. 3 is a fragmentary, top plan view of a modified form of the invention.
Figure 4:
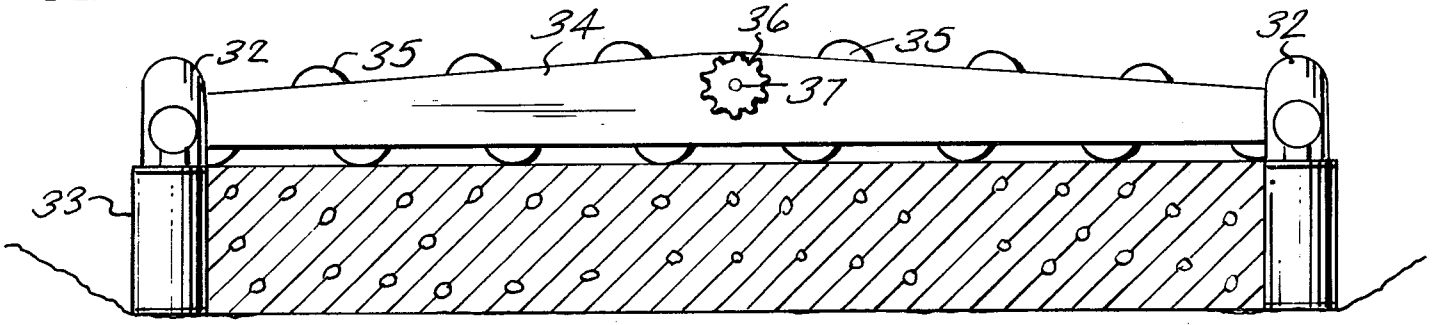
FIG. 4 is an end view of FIG. 3.

Referring now to FIGS. 3 and 4 of the drawings, a modified machine 29 is shown to include a frame 30, to which is attached wheels 31 and 32. To the parallel sides 33 are attached self-placing form units 33*a*, which operate in the same manner as heretofore described of machine 10. Frame 30 includes parallel, spaced-apart members 34, in which are rollers 35, which are driven, in a well-known manner, by means of drive sprocket 36 upon shaft 37. Units 33*a*, in conjunction with finishing rollers 35, serve as a means for concrete highway pavement finishing.

While various changes may be made in the detail construction, it is understood that such changes will be within the spirit and scope of the present invention, as is defined by the appended claims.

What I now claim is:

1. A self-placing automatic form machine, comprising a frame supported upon traction wheels, a concrete-mix hopper secured to one end of said frame, three self-placing form units secured to said frame for finishing the concrete mix, a plurality of parallel, spaced-apart rollers secured within said frame for engagement with the concrete mix, and a plurality of laterally moving rollers for finishing the concrete mix.

2. The combination according to claim 1, wherein said self-placing form units comprise three, one in each side wall of said frame and one intermediately spaced between said units in said side walls and said units each include an endless, synthetic rubber belt for rolling engagement with concrete mix, and said endless belts are driven by sprocket roller means, one in each end of said units and plate means on the top and bottom of each of said units overhangs the outer surface of said endless belts which prevents foreign matter and concrete mix from entering the interior of said units.

3. The combination according to claim 2, wherein said intermediate unit is angularly disposed alongside of the longitudinal axis of said machine for rolling engagement with a curb and a group of said plurality of finishing rollers are disposed adjacent and above one of said units secured to a side wall of said frame, said rollers being in a rolling engagement with the curb and are adjacent to a peripheral side edge of said intermediate unit.

4. The combination according to claim 3, wherein a group of said plurality of rollers are disposed between said intermediate unit and the unit on the opposite of said frame and wall means fixedly secured and at right angles to said side walls provides support means for drive-shaft and sprocket means and endless chain means for driving a plurality of rollers which are at right angles to said rollers adjacent to said intermediate unit, and said rollers upon said chain intermittently engage concrete mix in a rolling manner.

* * * * *